United States Patent [19]

Woron

[11] 4,245,542

[45] Jan. 20, 1981

[54] METHOD AND APPARATUS FOR TIMBRE CONTROL IN AN ELECTRONIC MUSICAL INSTRUMENT

[75] Inventor: Robert P. Woron, Allentown, Pa.

[73] Assignee: Allen Organ Company, Macungie, Pa.

[21] Appl. No.: 964,222

[22] Filed: Nov. 27, 1978

[51] Int. Cl.[3] ..... G10H 1/06

[52] U.S. Cl. ..... 84/1.26; 84/1.13; 84/1.19

[58] Field of Search ..... 84/1.13, 1.19, 1.22, 84/1.26, DIG. 12

[56] References Cited

U.S. PATENT DOCUMENTS

| | | | |
|---|---|---|---|
| 3,610,800 | 10/1971 | Deutsch | 84/1.01 |
| 3,636,231 | 1/1972 | Schrecongost et al. | 84/1.19 |
| 3,740,450 | 6/1973 | Deutsch | 84/1.23 |
| 3,763,364 | 10/1973 | Deutsch et al. | 84/1.03 |
| 3,809,786 | 5/1974 | Deutsch | 84/1.01 |
| 3,908,504 | 9/1975 | Deutsch | 84/1.26 |
| 3,913,442 | 10/1975 | Deutsch | 84/1.26 |
| 4,033,219 | 7/1977 | Deutsch | 84/1.26 |
| 4,062,264 | 12/1977 | Chase | 84/1.26 |
| 4,077,294 | 3/1978 | Hiyoshi et al. | 84/1.23 |
| 4,099,439 | 7/1978 | Lace | 84/1.26 |
| 4,114,498 | 9/1978 | Chibara et al. | 84/1.19 |
| 4,116,103 | 9/1978 | Deutsch | 84/1.24 |
| 4,119,005 | 10/1978 | Kondo et al. | 84/1.26 |
| 4,119,006 | 10/1978 | Whitefield | 84/1.26 |
| 4,122,742 | 10/1978 | Deutsch | 84/1.19 |
| 4,130,043 | 12/1978 | Nimi | 84/1.26 |
| 4,132,140 | 1/1979 | Chibara | 84/1.19 |
| 4,134,321 | 1/1979 | Woron | 84/1.24 |

OTHER PUBLICATIONS

Journal of the Acoustical Society of America, vol. 19, No. 4, pp. 535–541, "Decay Rates of Piano Tones", (Jul., 1947).

Journal of the Acoustical Society of America, vol. 34, No. 6, pp. 749–761, "Quality of Piano Tones", (Jun. 1962).

IRE Transactions on Audio, "Research and Development on the Piano", (Sep.–Oct., 1958).

Journal of the Audio Engineering Society, vol. 17, no. 3, pp. 266–271, "An Electric Piano", (Jun., 1969).

RCA, COS/MOS Integrated Circuits Manual, 1971, pp. 6–7.

Chowning, The Synthesis of Complex Audio Spectra by Means of Frequency Modulation, Computer Music Journal, Apr., 1977.

*Primary Examiner*—J. V. Truhe

*Assistant Examiner*—Forester W. Isen

*Attorney, Agent, or Firm*—Seidel, Gonda, Goldhammer & Panitch

[57] ABSTRACT

An electronic musical instrument is provided with a keyboard which may comprise one or more keyboard sections. Plural instrument voices are stored in memory for each section of the instrument keyboard. Each stored voice comprises a set of plural multiple bit digital words. A composite audible tone corresponding to an active key comprises varying combinations of component signals derived from the stored voices. The decay pattern of the composite audible tone is divided into successive time zones. The durations of the zones may vary. For each zone, the amplitude of at least one of the component signals of the composite tone is caused to decay while the amplitudes of the remaining component signals are either not modulated or are maintained at zero. The rate of decay of the amplitude of a component signal, hence the duration of a particular time zone, may be made a function of the keyboard section associated with the active key. In an alternative embodiment, the instrument voices are not stored in memory. Instead, plural octavely related frequency signals generated by the multiplexed accumulator of the instrument are combined to generate the signals which are to be modulated to obtain the decay pattern of the composite audible tone.

24 Claims, 18 Drawing Figures

DEMULTIPLEXING AUDIO WAVESHAPE GENERATOR CIRCUIT
DEMULTIPLEXING AUDIO WAVESHAPE GENERATOR CIRCUIT
DEMULTIPLEXING AUDIO WAVESHAPE GENERATOR CIRCUIT
DEMULTIPLEXING AUDIO WAVESHAPE GENERATOR
SELECTION FOR 4 KEYBOARD DECODER
ROM 1
ROM 2
ROM 3
ROM 4

SAMPLE GATING MODULATION LOGIC

METHOD AND APPARATUS FOR TIMBRE CONTROL IN AN ELECTRONIC MUSICAL INSTRUMENT

BACKGROUND OF THE INVENTION

The present invention is directed to a method and apparatus for controlling the timbre of audible tones produced by an electronic musical instrument. In particular, the invention is directed to a scheme of varying the decay pattern of the composite audible tone to simulate the audible tones of a piano or other percussive instrument such as a harpsichord, clavichord, guitar, banjo and so forth, and to synthesize, polyphonically, a wide variety of popular "electronic" tones.

BRIEF SUMMARY OF THE INVENTION

An audible percussive tone is produced in response to actuation of a key in a keyboard having one or more keyboard sections. Plural musical instrument voices are stored in memory. Each voice comprises a plurality of preselected digital words. The stored digital words are retrieved from memory, and a plurality of analog signals is produced based on the retrieved digital words. Alternatively, plural octavely related digital signals are produced in response to actuation of a key, and a plurality of analog signals is produced based on the octavely related digital signals. A composite audio signal is generated based on the analog signals. The composite audio signal comprises plural component signals. The component signals are caused to decay at least one signal at a time in a preselected sequence over plural successive time zones of preselected durations.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1A:
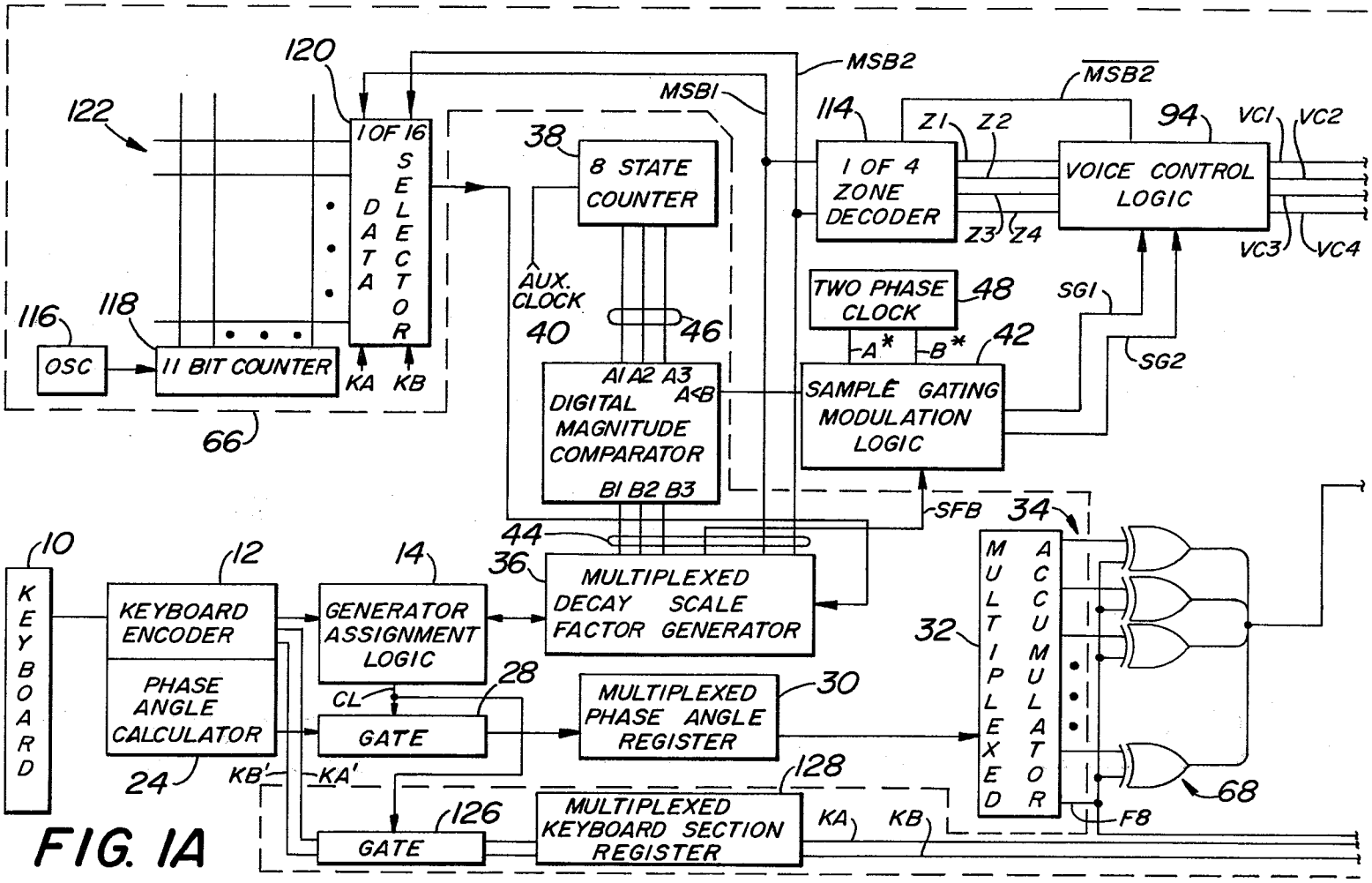
FIGS. 1A and 1B comprise a block diagram of the invention in the environment of a conventional digital computer organ.
Figure 1B:
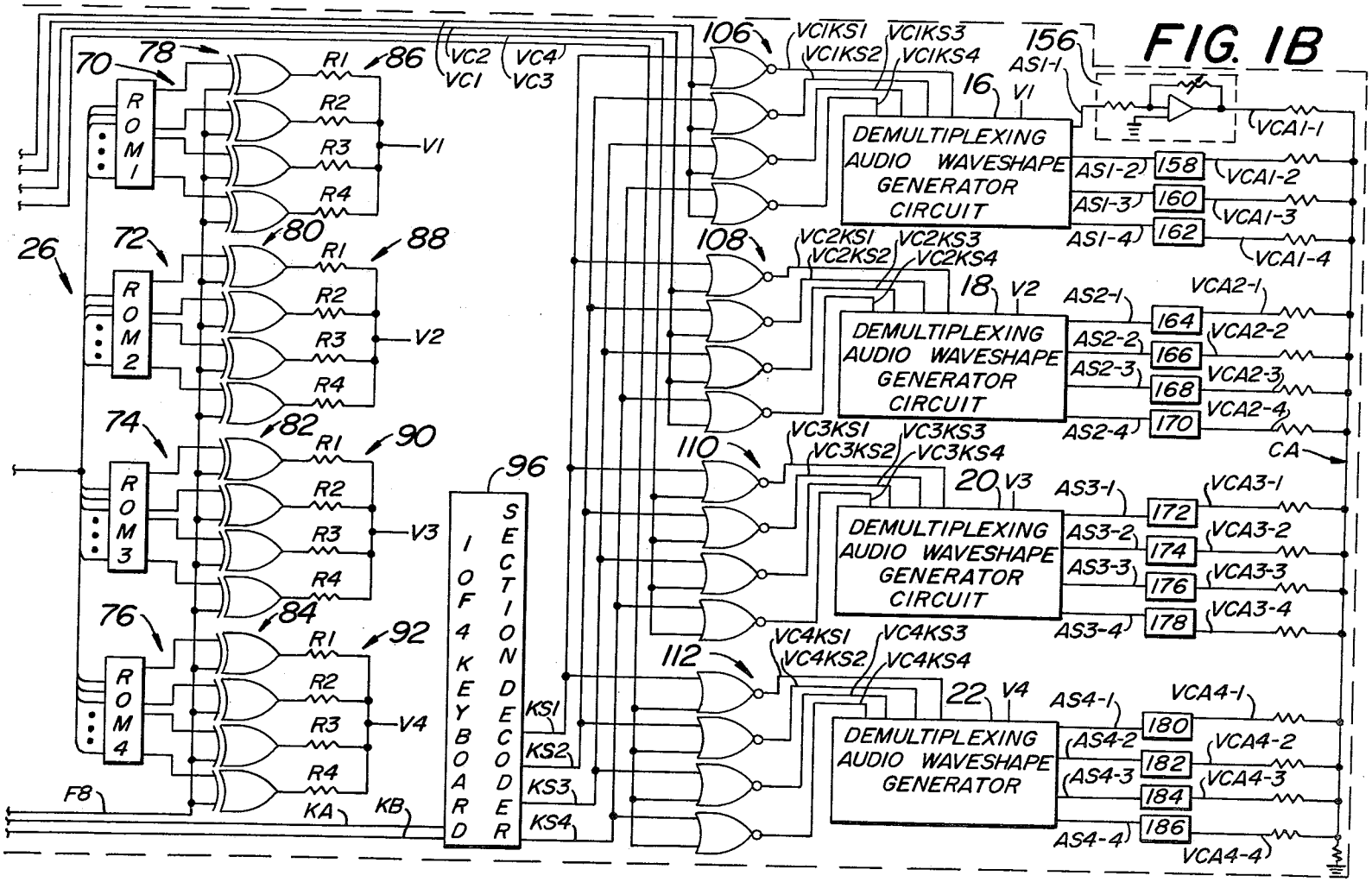

Referring to the drawings in detail, wherein like numerals indicate like elements, there is shown in FIGS. 1A and 1B a block diagram of the invention in the preferred environment of a conventional digital computer organ. The structure and function of such organs is well-known and is described, for example, in U.S. Pat. Nos. 3,610,799 and 3,639,913.

In such organs, a keyboard 10 is scanned in a time division multiplexing scheme by a keyboard encoder 12. The keyboard encoder 12 generates a time division multiplexed signal which is transmitted to a generator assignment logic circuit 14. The generator assignment logic circuit 14 controls the capture of various of the multiplexed channels of a demultiplexing audio wave shape generator (not shown) based on the keys of keyboard 10 which are active at any given instant of time. Typically, each key of the keyboard 10 is alloted a unique time slot. Each key time slot is itself divided into sub-time slots which represent the multiplexed wave shape generator channels of the instrument. Thus, for each active key, there are a plurality of audio wave shape generator sub-slots which are available for capture.

The instrument includes a phase angle calculator 24 associated with keyboard encoder 12. The phase angle calculator 24 calculates phase angle numbers in synchronism with the keyboard time division multiplexed signal. The output of the phase angle calculator 24 is transmitted via a gate 28 to a multiplexed phase angle register 30 under control of the generator assignment logic circuit 14. In this manner, the appropriate phase angle number generated by phase angle calculator 24 is transmitted to the phase angle register 30 for each multiplexed channel sub-slot. The multiplexed phase angle register has the capacity to store a particular phase angle number for each of the channel sub-slots.

The phase angle numbers stored in the phase angle register 30 are accumulated in their respective multiplexed channel sub-slots in a multiplexed accumulator 32. The multiplexed accumulator 32 accumulates phase angle numbers in each multiplexed channel sub-slot at a constant rate. The increase of the contents of the accumulator for a particular sub-slot is proportional to the magnitude of the phase angle numbers accumulated for that sub-slot.

The upper bit outputs 34 of the multiplexed accumulator 32 are related in binary fashion. The bits determine the rate of change of access of the voice memory to reconstruct a particular tone for each waveshape generator channel. The magnitudes of the phase angle numbers transmitted to the multiplexed accumulator 32 are chosen to cause one of the bit outputs 34, designated the F8 bit output, to toggle at the 8 foot musical frequency of the active key which has captured a wave shape generator assigned to the particular channel sub-slot. During each multiplexed wave shape generator channel sub-slot, frequencies which are octavely related to the F8 frequency are presented at the other multiplexed accumulator bit outputs 34.

Normally, each of the multiplexed accumulator outputs 34 are transmitted directly to the demultiplexing audio waveshape generator which produces an audible tone based on the multiplexed accumulator outputs 34 and a sample gating signal (not shown) produced by generator assignment logic 14. A demultiplexing audio waveshape generator of the type described herein is disclosed in detail in co-pending application Ser. No. 787,696 for "Demultiplexing Audio Waveshape Generator" assigned to the assignee herein. The application is incorporated herein by reference for purposes of general description of the environment of the present invention. The sample gating signal allows the demultiplexing audio waveshape generator to demultiplex the outputs 34 of the multiplexed accumulator 32 to to ensure that only those channels which have been captured by the generator assignment logic circuit 14 in response to one or more active keys will contribute to the audio output of the waveshape generator.

Typically, the audible tone produced by the demultiplexing waveshape generator is provided with a decay envelope by a multiplexed decay scale factor generator 36, a plural state counter 38, a digital magnitude comparator 40 and a sample gating modulation logic circuit similar to sample gating modulation logic circuit 42 described in detail hereinafter. See co-pending application Ser. No. 891,874 for "Method And Apparatus For Note Attack And Decay In An Electronic Musical Instrument" assigned to the assignee herein. The application is incorporated herein by reference for purposes of description of the environment of the present invention.

Decay scale factor generators such as generator 36 are well-known in the art, for example, see U.S. Pat. No. 3,610,805 and co-pending application Ser. No. 891,874. At any instant of time, the scale factor generator bit outputs 44 define a multiple bit digital word which represents the value by which the audio waveshape for a particular multiplexed generator channel is to be scaled to attain the desired decay envelope. Normally, the rate at which the scale factor generator outputs are generated is controlled by the multiplexed accumulator 32. In the present invention, however, the rate at which the scale factor generator outputs are generated is determined by a data selector 120 as described in detail hereinafter. Upon completion of a decay envelope, the decay scale factor generator 36 causes the generator assignment logic 14 to free the associated waveshape generator channel previously captured by the generator assignment logic.

Preferably, the counter 38 is an 8 state counter which is clocked by an auxiliary clock signal at the multiplex cycle rate of the waveshape generator channels. The counter outputs 46 are compared by a digital magnitude comparator 40 to the scale factor generator outputs 44 connected to the B1, B2 and B3 inputs of comparator 40. The "A<B" output of the digital magnitude comparator 40 is a frequency modulated sample gating signal which is applied to the sample gating modulation circuit 42. The sample gating modulation logic circuit 42 generates sample gating modulation signals SG1 and SG2 based on the A<B output of the digital magnitude comparator 40, the A* and B* pulse train outputs of a two phase clock 48, and the bit output (SFB) of the scale factor generator outputs 44.

Referring to FIG. 1A, as the decay scale factor outputs 44 which are connected to the B1, B2 and B3 outputs of comparator 40 decrease from a maximum scale factor value to zero for a particular multiplexed waveshape generator channel, the digital magnitude of the B1, B2 and B3 inputs initially almost always exceeds the digital magnitude of the A1, A2 and A3 inputs and the A<B output of comparator 40 will be high for each of the corresponding channel sub-slots. As the digital magnitude of the B1, B2 and B3 inputs decreases, the A<B output of comparator 40 will go low for certain of the corresponding channel sub-slots until, when the digital magnitude of the B1, B2 and B3 inputs is zero, the A<B output of comparator 40 will be low for each of the corresponding channel sub-slots.

Figure 7:
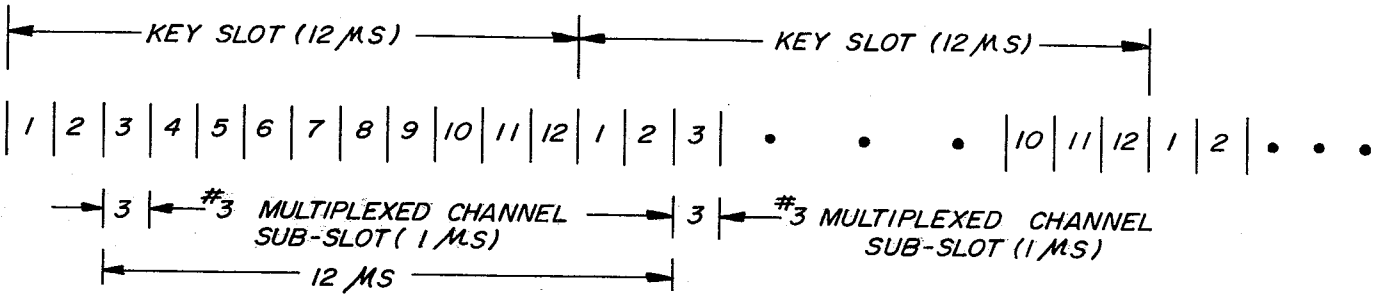
FIG. 7 is a chart of the multiplexed channels of a waveshape generator.
Figure 8:
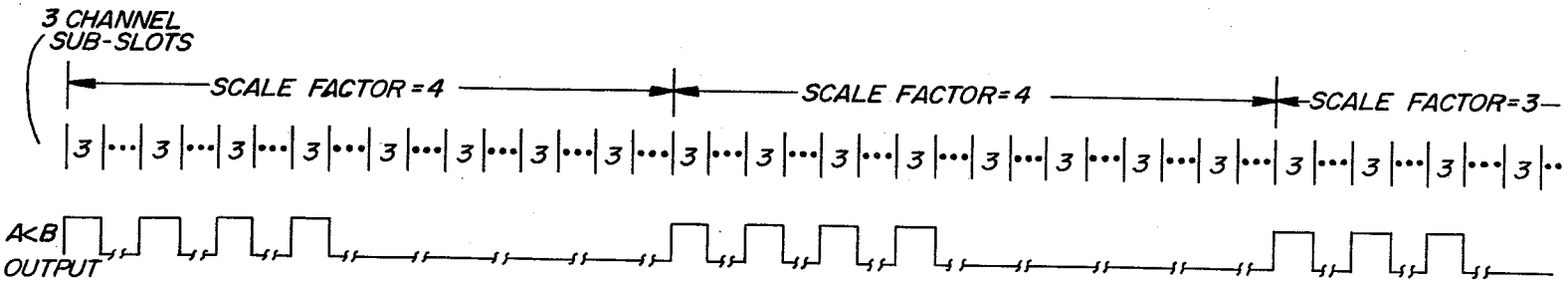
FIG. 8 is a chart of the frequency modulated sample gating signal for a waveshape generator channel.

For example, referring to FIGS. 7 and 8, a conventional keyboard and waveshape generator multiplexing scheme is shown. Each key of the keyboard 10 is alloted a 12 microsecond slot which is divided into 12 one microsecond sub-slots. Each sub-slot corresponds to a particular waveshape generator channel #1–12. For a particular generator channel, such as channel #3, the corresponding channel sub-slots will occur every 12 microseconds.

The 8 state counter 38 is clocked by an auxiliary clock and changes state at the multiplex channel cycle rate, namely, every 12 microseconds. The outputs 44 of the decay scale factor generator 36 which are connected to the B1, B2 and B3 inputs of the comparator are multiplexed outputs which change every 1 microsecond, that is, from one channel sub-slot to another. For the set of sub-slots corresponding to a particular channel, the outputs 44 of decay scale factor generator 36 will define a decreasing sequence of scale factors which are connected to the B1, B2 and B3 inputs of the comparator. Thus, the scale factor for a set of sub-slots corresponding to a particular channel will change to a new lower value at a rate much slower than the clock rate of counter 38. For a particular channel, the A<B output of comparator 40 will initially be high for almost all the corresponding channel sub-slots, and the A<B output will become low for more and more of the corresponding channel sub-slots until the A<B output becomes zero for each of the corresponding channel sub-slots.

The A<B output of comparator 40 therefore constitutes a frequency modulated sample gating signal which occurs during a channel sub-slot and which indicates whether a particular waveshape generator channel corresponding to the sub-slot is active or not. More specifically, the A<B output of comparator 40 constitutes a once (frequency) modulated sample gating signal. This once modulated sample gating signal may be transmitted directly to the demultiplexing audio waveshape generator to control the on and off times of the generator. Accordingly, each waveshape generator channel will be active over less and less of the set of sub-slots corresponding to a particular channel as the outputs 44 of decay scale factor generator 36 connected to the B1, B2 and B3 inputs of comparator 40 decrease in magnitude. Thus, the audible tone produced by the waveshape generator for that particular channel will gradually decrease in amplitude to define the decay envelope.

Figure 6:
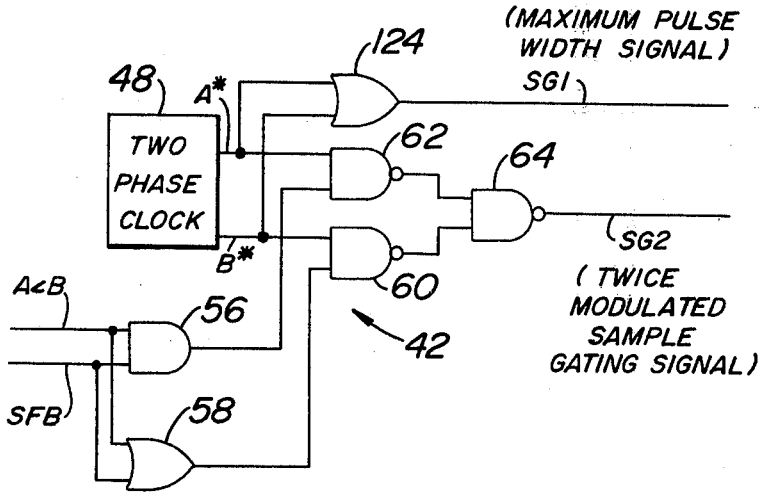
FIG. 6 is a diagram of the digital components of the sample gating modulation logic.

The decay envelope may be smoothed by further modulation of the once modulated sample gating signal under control of the two phase clock 48. See FIG. 6.

The two phase clock 48 generates a pair of non-overlapping pulse trains A* and B* having pulses of equal width and repetition frequency. The repetition frequency of each pulse train is the multiplex channel frequency, namely, one pulse every one microsecond. The durations of the pulses of each pulse train are such that a pair of side-by-side pulses (one from each pulse train) will fit within a 1 μs multiplexed channel sub-slot.

Additional modulation of the once modulated sample gating signal is controlled by the SFB bit output of the outputs 44 of decay scale factor generator 36. The SFB output of the decay scale factor generator 36 will change state at the mid-way point of the decay envelope for a particular channel.

For the first half of the decay envelope for a particular channel, the SFB output is high, enabling AND gate 56 to pass the once modulated sample gating signal (the A<B output of comparator 40) to NAND gate 62. At the same time, the SFB output holds the output of OR gate 58 high, so that NAND gate 60 is enabled. NAND gate 62 modulates the pulse widths of the once modulated sample gating signal (passed by AND gate 56) under control of the pulse train A* generated by the two phase clock 48. In particular, the once modulated sample gating signal is inverted and modulated in pulse width by NAND gate 62 and transmitted to NAND gate 64. In addition, the pulse train B* is inverted by NAND gate 60 and transmitted to NAND gate 64. The output of NAND gate 62 is combined with the output of NAND gate 60 by the NAND gate 64 to produce a combined or twice modulated (frequency and pulse width) signal at the output SG2.

For the second half of the decay envelope for a particular channel, the SFB signal is low, disabling AND gate 56 while permitting the once modulated sample gating signal (the A<B output of comparator 40) to pass through OR gate 58 to NAND gate 60. The once modulated sample gating signal passed by OR gate 58 is modulated in pulse width by NAND gate 60 under control of the pulse train B* generated by the two phase clock 48. Since the SFB signal disables AND gate 56 during this time, AND gate 56 in turn disables NAND gate 62. The NAND gate 62 therefore enables NAND gate 64 to invert the pulse width modulated sample gating signal from NAND gate 60. The twice modulated (frequency and pulse width) signal appears at the SG2 output.

Thus, at the beginning of the decay envelope, the SG2 signal maintains the particular waveshape generator channel in an active state and, as the decay envelope progresses toward zero, the SG2 signal maintains the waveshape generator channel in an active state for progressively decreasing durations of time.

A sample gating modulation circuit of the type described herein is disclosed in detail in co-pending patent application Ser. No. 891,874 for "Method And Apparatus For Note Attack And Decay In An Electronic Musical Instrument" assigned to the assignee herein. The application is incorporated herein by reference for purposes of disclosure of the environment of the instant invention.

It should be noted that the elements heretofore described are intended for use in a scheme employing an audio waveshape generator which is multiplexed over a set of channels, typically 12 in number. The audible tone produced for each channel of the generator is impressed with a decay envelope so that the amplitude of the signal is modulated during decay while the harmonic content of the signal is not varied. The present invention is directed to a scheme of varying the harmonic content of an audible tone produced in a generator channel. The invention is segregated from the conventional elements heretofore described by broken lines 66 in FIGS. 1A and 1B.

In a preferred embodiment of the present invention, the multiplexed accumulator outputs 34 are connected via a bank of EXCLUSIVE OR gates 68 to a voice/-keyboard section memory 26. The multiplexed accumulator 32 addresses the memory 26 to read out from the memory 4 bit voice sample point outputs 70, 72, 74 and 76 as described more fully hereinafter. Each of the 4 bit outputs 70, 72, 74 and 76 defines a voice sample point stored in the memory 26. The 4 bit digital outputs 70, 72, 74 and 76 are transmitted, respectively, through banks of EXCLUSIVE OR gates 78, 80, 82 and 84 to identical resistive networks 86, 88, 90 and 92. The EXCLUSIVE OR gates 78, 80, 82 and 84 are controlled in unison with EXCLUSIVE OR gates 68 by the F8 output of the multiplexed accumulator 32 to control the direction of addressing of the memory 26 and therefore the order in which the sample point outputs 70, 72, 74 and 76 are read out of memory 26, as described more fully hereinafter. The outputs of resistive networks 86, 88, 90 and 92 are, respectively, analog signals V1, V2, V3 and V4. As described more fully below, these analog signals, in combination, define the harmonic content of the composite audible tone produced by waveshape generator circuits 16, 18, 20 and 22 and, in particular, the harmonic content of the composite audible tone during decay.

In the preferred embodiment herein, each of the demultiplexing audio waveshape generator circuits 16, 18, 20 and 22 are identical and comprise a bank of 4 analog switches. The on/off states of the analog switches are controlled by a voice control logic circuit 94 and a 1 of 4 keyboard section decoder 96. See FIGS. 1A and 1B. The demultiplexing audio waveshape generator circuits 16, 18, 20 and 22 being identical, it will suffice for purposes of explanation herein to limit the description of the audio waveshape generator circuits to the waveshape generator circuit 16 shown in FIG. 10.

Figure 10:
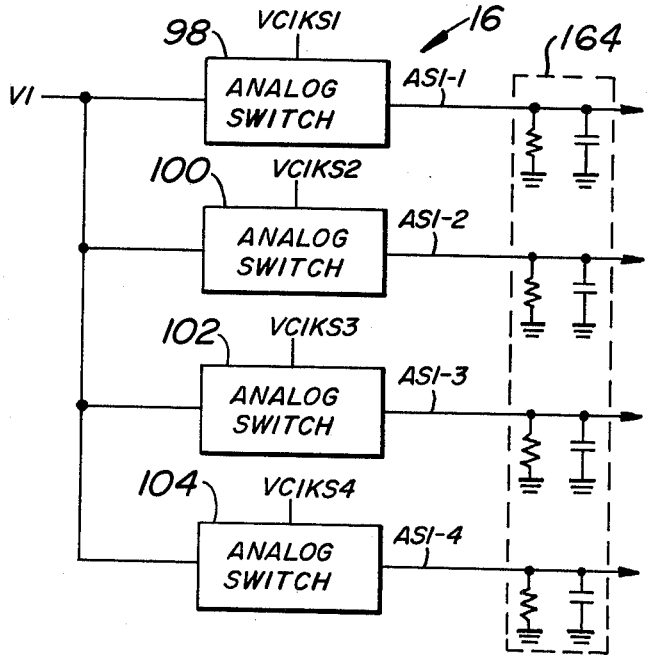
FIG. 10 is a diagram of the components of a demultiplexing audio waveshape generator circuit.

Referring to FIG. 10, the demultiplexing audio waveshape generator circuit 16 comprises a bank of 4 identical analog switches 98, 100, 102 and 104. The inputs of the analog switches are tied together to the analog output V1 of resistive network 86. The on/off states of analog switches 98, 100, 102 and 104 are controlled, respectively, by signals VC1KS1, VC1KS2, VC1KS3 and VC1KS4. The signals VC1KS1, VC1KS2, VC1KS3 and VC1KS4 are generated by NOR gates 106. See FIG. 1B. Similarly, audio waveshape generator circuit 18 comprises a bank of 4 analog switches whose inputs are connected together to the analog output V2 of resistive network 88 and whose on/off states are controlled by the bank of NOR gates 108; audio waveshape generator circuit 20 comprises a bank of 4 analog switches whose inputs are connected together to the analog output V3 of resistive network 90 and whose on/off states are controlled by NOR gates 110; audio waveshape generator circuit 22 comprises a bank of 4 analog switches whose inputs are connected together to the analog output V4 of resistive network 92 and whose on/off states are controlled by NOR gates 112.

In the preferred embodiment described herein, keyboard 10 comprises 4 keyboard sections although it should be understood that a keyboard 10 having more or less than 4 keyboard sections, including the case of only one keyboard section, may be used within the scope of the invention. The keyboard encoder 12 generates a pair of signals KA′ and KB′ which, in combination, serve to identify any one of the four keyboard sections being scanned at any given instant of time. See FIG. 1A. The KA′ and KB′ outputs of the keyboard encoder 12 are gated via a gate circuit 126 to a multiplexed keyboard section register circuit 128 under control of a "claimed" signal designated CL which is generated in conventional fashion by generator assignment logic 14. The CL signal indicates that a particular waveshape generator channel has been captured by an active key. Generation of the CL signal by the generator assignment logic is described for example in U.S. Pat. No. 3,610,799.

Figure 15:
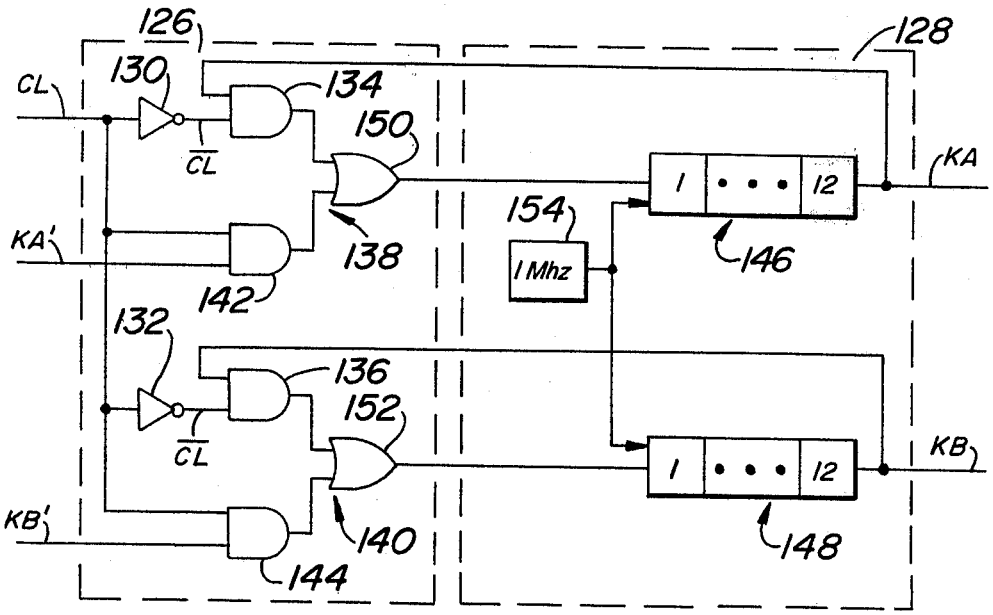
FIG. 15 is a diagram of the digital components of the keyboard section gate and the multiplexed keyboard section register.

The internal structures of gate 126 and multiplexed keyboard section register 128 are shown in detail in FIG. 15. The CL signal is inverted by inverters 130 and 132 and is then passed to AND gates 134 and 136 in AND-OR circuits 138 and 140, respectively. The CL signal itself is transmitted directly to AND gates 142 and 144 in AND-OR circuits 138 and 140 respectively. The AND gates 134 and 136 are respectively enabled (or disabled) by the KA and KB outputs of 12-stage shift registers 146 and 148 in the multiplexed keyboard section register circuit 128. The 12-stage shift registers 146 and 148 are clocked simultaneously by a 1 Mhz clock 154. Accordingly, the outputs of OR gates 150 and 152 will be shifted into registers 146 and 148, respectively, every 1 μs, i.e., every multiplexed channel sub-slot. In addition, the signals shifted into the first stages of registers 146 and 148 will circulate back to the AND gates 134 and 136, respectively, every 12 μs, i.e., at the repetition frequency of the sub-slots corresponding to a particular channel.

When the CL signal is high, indicating that the sub-slots corresponding to a particular channel are to be captured by an active key, the KA′ and KB′ signals are passed by AND-OR circuits 138 and 140 to the first stages of shift registers 146 and 148, respectively. When the CL signal is low, indicating that no sub-slots corresponding to a particular channel are to be captured, the CL signal disables AND gates 142 and 144, preventing transmission of the KA′and KB′ signals to shift registers 146 and 148. The AND gates 134 and 136, however, are enabled by the inverted CL signai, designated $\overline{CL}$, to pass the KA and KB outputs of shift registers 146 and 148 via OR gates 150 and 152, respectively to the first stages of the shift register.

The KA and KB outputs of the multiplexed keyboard section register circuit 128 are decoded by 1 of 4 keyboard section decoder 96 which generates a low signal at one of the outputs designated KS1, KS2, KS3 or KS4 at any given instant of time. See FIG. 1B. The outputs KS1, KS2, KS3 and KS4, therefore, identify a keyboard section associated with an active key at any given instant of time.

In the preferred embodiment herein, the voice control logic circuit 94 generates 4 voice control outputs VC1, VC2, VC3 and VC4. See FIG. 1A. The VC1, VC2, VC3 and VC4 outputs determine the sequence of decay of the components of the composite audio signal CA (FIG. 1B) as described more fully hereinafter.

As previously indicated, the waveshape generator circuits 16, 18, 20 and 22 are identical. Each circuit comprises four analog switches. FIG. 10 shows the interconnection of the analog switches of circuit 16 and is representative of the interconnection of the analog switches of circuits 18, 20 and 22 to the other components of the invention. Referring to FIGS. 1B and 10, the output of each analog switch of circuit 16 designated AS1-1, AS1-2, AS1-3 and AS1-4, is connected through a bank of RC circuits 164 to identical adjustable gain amplifiers 156, 158, 160 and 162. The RC circuits 164 act as low pass filters, and the components of the RC circuits are selected to color the composite audio signal CA as desired. Other types of filter circuits may be employed in place of or in combination with the RC circuit to obtain the desired composite signal CA.

Similarly, referring to FIG. 1B, the analog switch outputs AS2-1, AS2-2, AS2-3 and AS2-4 of circuit 18 are connected through a bank of RC circuits (not shown) to adjustable gain amplifiers 164, 166, 168 and 170; the analog switch outputs AS3-1, AS3-2, AS3-3 and AS3-4 of circuit 20 are connected through a bank of RC circuits (not shown) to adjustable gain amplifiers 172, 174, 176 and 178; and the analog switch outputs AS4-1, AS4-2, AS4-3 and AS4-4 of circuit 22 are connected through a bank of RC circuits (not shown) to adjustable gain amplifiers 180, 182, 184 and 186. The outputs of the adjustable gain amplifiers 156–186 are designated VCA1-1 through VCA1-4 (the VCA1 outputs), VCA2-1 through VCA2-4 (the VCA2 outputs), VCA3-1 through VCA3-4 (the VCA3 outputs) and VCA4-1 through VCA4-4 (the VCA4 outputs). See FIG. 1B. These outputs are the component signals of the composite audio signal CA and are summed in a resistive network (not numbered) to form the composite audio signal CA. At any given instant of time, one or more of the VCA1, VCA2, VCA3 and VCA4 outputs of the adjustable gain amplifiers, i.e., one or more of the component signals of composite audio signal CA, may be decaying depending on the keyboard activity and the decay pattern of the VCA1, VCA2, VCA3 and VCA4 outputs. The component signals of the composite audio signal CA which may be decaying at any instant of time are correlated with keyboard activity in Table 1 below.

TABLE 1

| Component of Composite Signal CA Which May Be Decaying | Keyboard Section Associated with Active Key |
|---|---|
| VCA1-1 | 1 |
| VCA2-1 | |
| VCA3-1 | |
| VCA4-1 | |
| VCA1-2 | 2 |
| VCA2-2 | |
| VCA3-2 | |
| VCA4-2 | |
| VCA1-3 | 3 |
| VCA2-3 | |
| VCA3-3 | |
| VCA4-3 | |
| VCA1-4 | 4 |
| VCA2-4 | |
| VCA3-4 | |
| VCA4-4 | |

Figure 9:
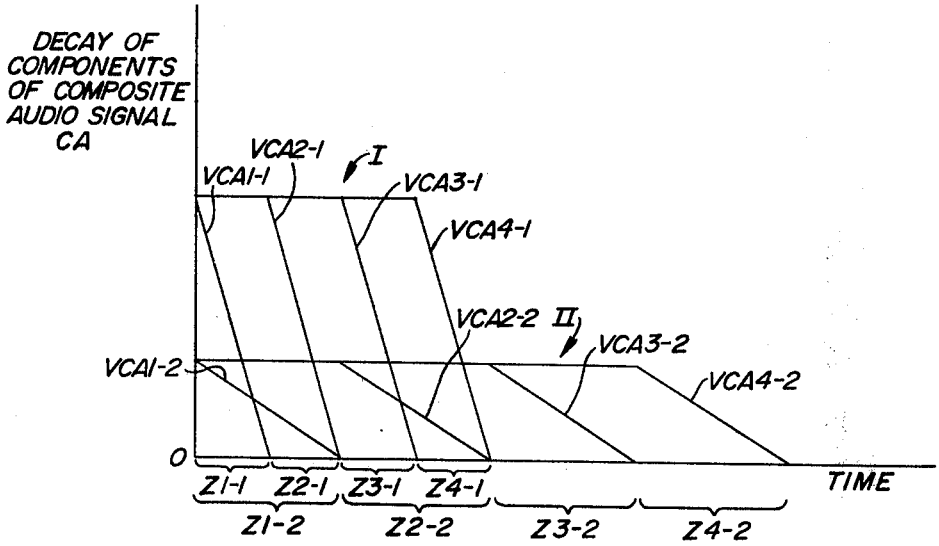
FIG. 9 is a graph of the decay pattern of the components of a composite audible tone.

Assuming, for simplicity of description, that only keyboard section 1 is associated with an active key, the component signal of the composite signal CA will vary for, for example, according to the graph labeled I shown in FIG. 9. Thus, during time zone Z1-1, the component signal VCA1-1 decays to zero while the component signals VCA2-1, VCA3-1 and VCA4-1 do not decay at all. During time zone Z2-2, the component signal VCA2-1 decays to zero, the component signals VCA3-1 and VCA4-1 do not decay at all, and the component signal VCA1-1 is zero (having decayed to zero during time zone Z1-1). During time zone Z3-1, the component signal VCA3-1 decays to zero, component signal VCA4-1 does not decay at all, and component signals VCA1-1 and VCA2-1 are zero (having already decayed to zero during time zones Z1-1 and Z2-1 respectively). In the last time zone, time zone Z4-1, the component signal VCA4-1 decays to zero while component signals VCA1-1, VCA2-1 and VCA3-1 are zero (having decayed to zero during time zones Z1-1, Z2-1 and Z3-1 respectively). Thus, during any of the time zones Z1-1, Z2-1, Z3-1 or Z4-1, at least one of the component signals of the composite signal CA will be decaying while the other component signals are either zero or are not decaying at all.

Although the component signals VCA1-1, VCA2-1, VCA3-1 and VCA4-1 of the composite signal CA are shown in graph I in FIG. 9 as decaying from the same initial amplitude, it should be understood that the component signals may actually decay from different initial amplitudes so that the slope of each of the lines may be greater or less than the slopes shown in FIG. 9. In addition, although the time zones during which a particular group of component signals of composite signal CA decay (such as the group of zones Z1-1, Z2-1, Z3-1 and Z4-1) are shown to be of the same duration in FIG. 9, the time zones may be made to progressively increase (or decrease) in length as described more fully hereinafter.

The time zones during which the component signals of the composite signal CA decay may be made to vary as a function of the particular keyboard section associated with an active key. For example, if keyboard section 2 is associated with an active key, the component signals of the composite signal CA corresponding to that key will vary according to the graph labeled II in FIG. 9. The component signals VCA1-2, VCA2-2, VCA3-2 and VCA4-2 will decay sequentially over time zones Z1-2, Z2-2, Z3-2 and Z4-2 respectively. These time zones may be greater in length than the time zones Z1-1, Z2-1, Z3-1 and Z4-1 described in connection with the decay of the component signals which correspond to an active key associated with keyboard section 1. Similar variations may be obtained in the durations of the time zones for the decay of the component signals which correspond to an active key associated with keyboard section 3 or keyboard section 4. In the following description of the invention, the first time zone in the decay pattern of the component signals corresponding to a particular keyboard section is designated Z1-, the second time zone is designated Z2-, the third time zone is designated Z3-, and the fourth time zone is designated Z4-.

Assuming that the time zones during which the component signals of the composite signal CA decay are made to vary as a function of the particular keyboard section associated with an active key, it is necessary to (1) identify the keyboard section associated with an active key and (2) identify the particular time zone Z1-, Z2-, Z3- or Z4- of the decay cycle so that the component signals decay in sequence as the decay cycle progresses from time zone to time zone.

Identification of the keyboard section containing the active key is accomplished by the 1 of 4 keyboard section decoder 96. See FIG. 1B. In particular, the KS1-KS4 outputs of decoder 96 serve to identify a keyboard section associated with an active key.

Identification of a time zone is accomplished by 1 of 4 zone decoder 114. See FIG. 1A. The two most significant bit outputs MSB1 and MSB2 of the decay scale factor generator 36 serve to identify the time zones Z1-, Z2-, Z3- or Z4-. Variation of the rate of decay of a component signal of the composite signal CA, hence the duration of a time zone, is accomplished by oscillator 116, counter 118 and one of 16 data selector 120. The MSB1 and MSB2 bits are transmitted together with the KA and KB signals to one of 16 data selector 120 to determine the clock rate of the decay scale factor generator 36. The counter 118 is preferably an 11 bit counter clocked at an arbitrary predetermined fixed frequency by the oscillator 116. The 11 bit counter 118 is coupled by a jumper matrix to the 16 data inputs of the data selector 120. The keyboard identification signals KA and KB and the time zone identification signals MSB1 and MSB2 determine which of the 16 data inputs to the data selector 120 will be passed to the clock input of the decay scale factor generator 36. Accordingly, a variety of clock rates is available at the clock input of the decay scale factor generator 36 based on the identity of the time zone and the identity of the keyboard section associated with an active key.

Figure 5:
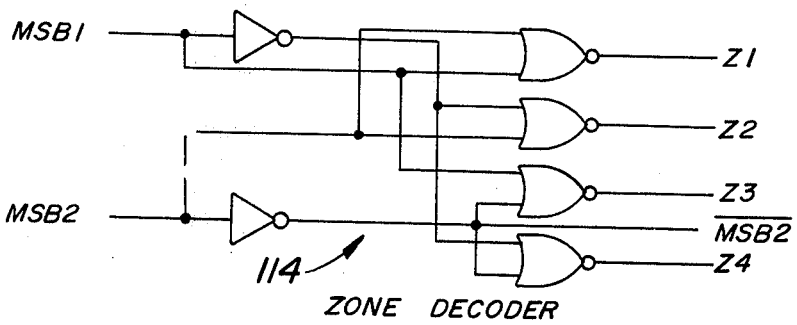
FIG. 5 is a diagram of the digital components of the decay zone decoder.

Zone decoder 114 is shown in detail in FIG. 5. The zone decoder 114 decodes the 2 most significant bit outputs (MSB1 and MSB2) of the decay scale factor generator 36. The MSB1 and MSB2 bit outputs identify the time zones Z1-, Z2-, Z3- or Z4- as previously indicated. Each time zone corresponds to the time required for the complete decay of at least one component signal of composite audio signal CA. Operation of the zone decoder 114 is more particularly illustrated in Table 2 below.

TABLE 2

| MSB1 | MSB2 | Z1 | Z2 | Z3 | Z4 | $\overline{\text{MSB2}}$ |
|---|---|---|---|---|---|---|
| 0 | 0 | 1 | 0 | 0 | 0 | 1 |
| 1 | 0 | 0 | 1 | 0 | 0 | 1 |
| 0 | 1 | 0 | 0 | 1 | 0 | 0 |
| 1 | 1 | 0 | 0 | 0 | 1 | 0 |

During the first time zone Z1-, the Z1 output of zone decoder 114 is high while the Z2-Z4 outputs are low. During the next time zone Z2- in the decay cycle, the Z2 output of decoder 114 is high while the Z1 and Z3-Z4 outputs are low. Similarly, during the third time zone Z3- in the decay cycle, the Z3 output of decoder 114 is high while the Z1-Z2 and Z4 outputs are low. And during the last or fourth time zone Z4- in the decay cycle, the Z4 output of decoder 114 is high while the Z1-Z3 outputs are low.

As previously indicated, the MSB1 and MSB2 bit outputs of the decay scale factor generator 36 are also used, in conjunction with the KA and KB outputs of multiplexed keyboard section register 128, to select one of 16 possible pulse trains transmitted through the jumper matrix 122. The jumper matrix 122 is an 11 column by 16 row matrix which is connected to combine the 11 stage outputs of counter 118 to provide 16 pulse trains of different frequencies at the inputs of the data selector 120. As previously indicated, the KA and KB outputs of the keyboard section register 128 identify the keyboard section associated with an active key for each generator channel sub-slot. For each active key in a keyboard section, therefore, the MSB1 and MSB2 outputs and the KA and KB outputs identify the sequence and rates of decay of the component signals of the composite audible tone CA corresponding to the active key.

Figure 3:
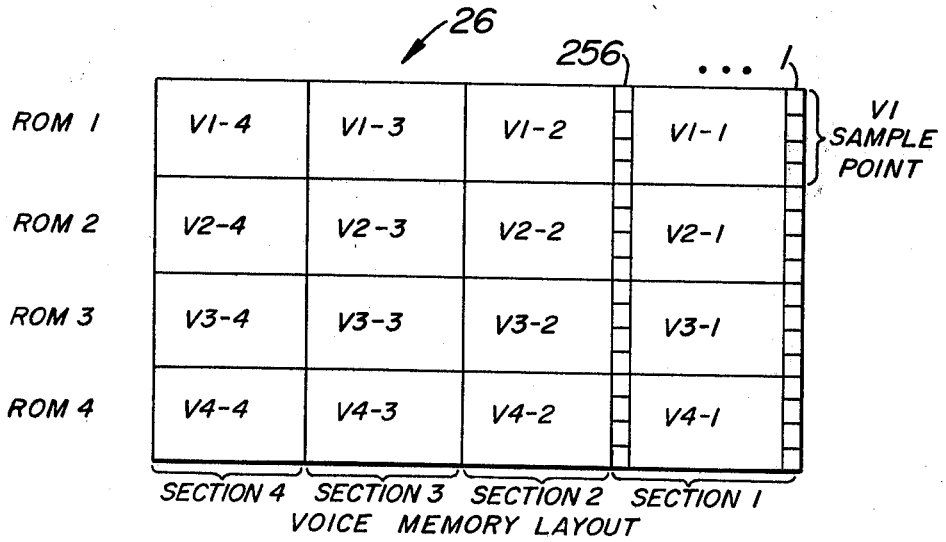
FIG. 3 is a lay-out of the voice memory.
Figure 4:
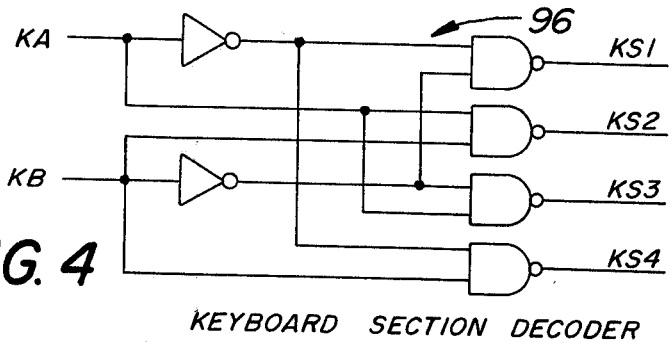
FIG. 4 is a diagram of the digital components of the keyboard section decoder.

Typically, keyboard 10 comprises 4 keyboard sections, and there are 4 voice waveforms for each keyboard section. See FIG. 3. The data selector 120 transmits a pulse train of preselected frequency for each time zone and each keyboard section. The frequency of the pulse train transmitted by data selector 120 may be made to decrease as the frequency of the keys associated with each keyboard section decreases. The lowest frequency pulse train would then be transmitted by the data selector 120 when the keyboard section having the lowest keys is active. The highest frequency pulse train would be transmitted by the data selector 120 when the keyboard section having the highest keys is active. Such a progression of frequencies of the pulse trains is indicated in Table 3 below.

TABLE 3

| Keyboard Section (KS) | Time Zone | Frequency of Output of Data Selector 120 |
|---|---|---|
| 1 | Z1-1 | f1 |
| | Z1-2 | f2 |
| | Z1-3 | f3 |
| | Z1-4 | f4 |
| 2 | Z2-1 | f5 |
| | Z2-2 | f6 |
| | Z2-3 | f7 |
| | Z3-4 | f8 |
| 3 | Z3-1 | f9 |
| | Z3-2 | f10 |
| | Z3-3 | f11 |
| | Z3-4 | f12 |
| 4 | Z4-1 | f13 |
| | Z4-2 | f14 |
| | Z4-3 | f15 |
| | Z4-4 | f16 |

It should be noted that in Table 3 frequency f2 would be lower than frequency f1, frequency f3 would be lower than frequency f2, and so forth. Keyboard section 1 is presumed to contain the highest order keys, keyboard section 2 contains lower order keys, keyboard section 3 contains the next lowest order keys, and keyboard section 4 contains the lowest order keys of all keyboard sections. Accordingly, the decay scale factor generator 36 is clocked at differing rates f1–f16 depending on the keyboard section in which an active key is located and depending on the particular time zone Z1-, Z2-, Z3- or Z4- in the decay pattern.

Of course, the frequencies f1–f16 may be made to vary with the keyboard section order in any other manner without exceeding the scope of the present invention. For example, any frequency may be made less than, equal to, or greater than any other frequency.

Preferably, the voice/keyboard section memory 26 is arranged in 4 sections designated ROM1, ROM2, ROM3 and ROM4. See FIG. 3. Each of these sections is divided into 4 subsections corresponding to the 4 keyboard sections. In each subsection, voice information is stored in the form of 256 4-bit sample point words. Each set of 256 words defines a voice waveform. ROM1 contains voice waveforms V1-1, V1-2, V1-3 and V1-4. ROM2 contains voice waveforms V2-1, V2-2, V2-3 and V2-4. ROM3 contains voice waveforms V3-1, V3-2, V3-3 and V3-4. And ROM4 contains voice waveforms V4-1, V4-2, V4-3 and V4-4. The correspondence between ROMs1-4, keyboard sections and voices is summarized in Table 4 below.

TABLE 4

| ROM | Keyboard Section | Voice Waveform Stored in Memory |
|---|---|---|
| 1 | 1 | V1-1 |
| | 2 | V1-2 |
| | 3 | V1-3 |
| | 4 | V1-4 |
| 2 | 1 | V2-1 |
| | 2 | V2-2 |
| | 3 | V2-3 |
| | 4 | V2-4 |
| 3 | 1 | V3-1 |
| | 2 | V3-2 |
| | 3 | V3-3 |
| | 4 | V3-4 |
| 4 | 1 | V4-1 |
| | 2 | V4-2 |
| | 3 | V4-3 |
| | 4 | V4-4 |

As previously indicated, each of the ROMs1-4 is addressed by the multiplexed accumulator 32 via the EXCLUSIVE OR gates 68. The ROMS1-4 are addressed simultaneously column by column, beginning from the righthand side of a memory sub-section and proceeding in sequence to the lefthand side of the subsection. See FIG. 3. Thus, the first 4 bit sample points of voices V1-1, V2-1, V3-1 and V4-1 are simultaneously read out of ROMs1-4 and transmitted to EXCLUSIVE OR gates 78, 80, 82 and 84. In this manner, the first voice sample points for the first keyboard section are read out of ROMs1–4, the second voice sample points for the first keyboard section are then read out of ROMs1–4, and so forth until the 256th voice sample points for the first keyboard section are read out of ROMs1–4.

Preferably, each voice waveform possesses odd symmetry, i.e., the magnitudes of the sample points of each ½ cycle of the waveform are reversed in sign and occur in reverse order. Accordingly, only one-half of the voice waveform information need be stored in memory 26. Each voice sample point stored in memory 26, then, corresponds to the absolute magnitude of either a sample point on one ½ cycle of the waveform or a sample point on the other ½ cycle of waveform.

To retrieve the sample point information for one ½ cycle, the bit output F8 of multiplexed accumulator 32 causes the EXCLUSIVE OR gates 68 to address the sub-sections of memory 26 from right to left as previously described. The sample point information read out of memory 26 is transmitted through EXCLUSIVE OR gates 78, 80, 82 and 84 under control of the bit output F8. The sample point information for the other ½ cycle is retrieved when the bit output F8 changes state causing the multiplexed accumulator 32 to address the subsections of memory 26 via EXCLUSIVE OR gates 68 in the reverse direction, that is, from left to right. Simultaneously, the bit output F8 controls the EXCLUSIVE OR gates 78, 80, 82 and 84 to cause the EXCLUSIVE OR gates to transmit the digital complements of the outputs of ROMS 1–4 to resistive networks 86, 88, 90 and 92. As a result, the sign of the magnitude of the analog signals V1–V4 is reversed.

The voice waveform information read out of memory 26 for any keyboard section, for example, the voice waveforms V1-1, V2-1, V3-1 and V4-1 for the first keyboard section, is converted to analog signals V1–V4 by resistive networks 86, 88, 90 and 92 as already indicated. The correspondence between voice information, keyboard sections, and analog signals is illustrated in Table 5 below.

TABLE 5

| Voice Waveform Stored in Memory | Keyboard Section | Analog Signal |
|---|---|---|
| V1-1 | 1 | V1 |
| V2-1 | | V2 |
| V3-1 | | V3 |
| V4-1 | | V4 |
| V1-2 | 2 | V1 |
| V2-2 | | V2 |
| V3-2 | | V3 |
| V4-2 | | V4 |
| V1-3 | 3 | V1 |
| V2-3 | | V2 |
| V3-3 | | V3 |
| V4-3 | | V4 |
| V1-4 | 4 | V1 |
| V2-4 | | V2 |
| V3-4 | | V3 |
| V4-4 | | V4 |

The analog signals V1–V4 are transmitted to the demultiplexing audio waveshape generator circuits 16, 18, 20 and 22. See FIGS. 1B and 10. The voice control logic circuit 94 provides the outputs VC1–VC4 which are used by the waveshape generator circuits 16, 18, 20 and 22 to impress the desired decay envelope on the analog signals V1–V4.

Figure 2:
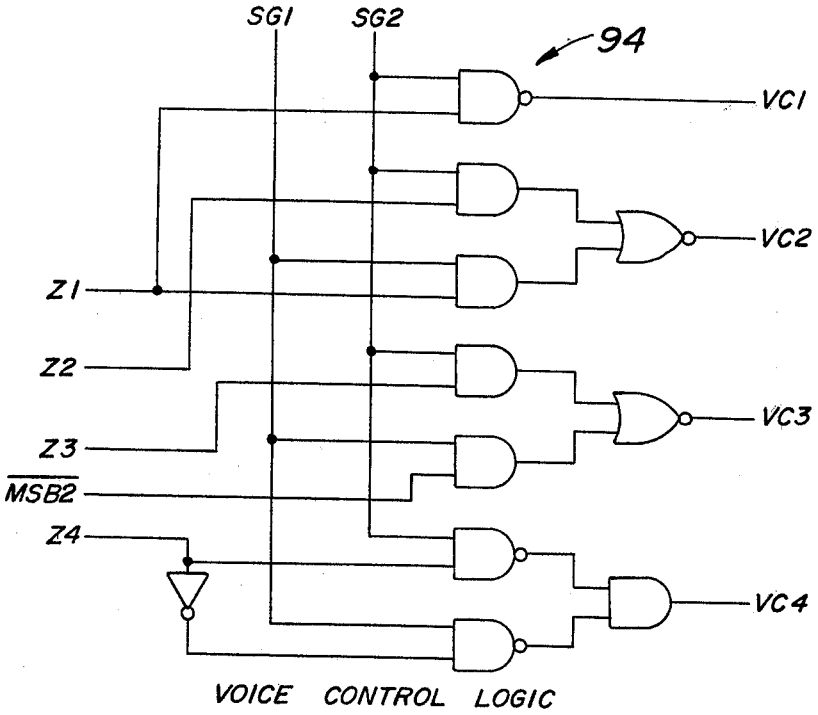
FIG. 2 is a diagram of the digital components of the voice control logic circuit.

The voice control logic circuit 94 is shown in detail in FIG. 2. The outputs VC1–VC4 contain the modulation provided by the sample gating modulation circuit 42 (signals SG1 and SG2) for each of the time zones Z1- through Z4- in the decay cycle as described more fully hereinafter. The operation of the voice control logic circuit is illustrated in Table 6 below.

TABLE 6

| Z1 | Z2 | Z3 | Z4 | $\overline{MSB2}$ | VC1 | VC2 | VC3 | VC4 |
|---|---|---|---|---|---|---|---|---|
| 1 | 0 | 0 | 0 | 1 | $\overline{SG2}$ (decay) | $\overline{SG1}$ (full) | $\overline{SG1}$ (full) | $\overline{SG1}$ (full) |
| 0 | 1 | 0 | 0 | 1 | 1 (off) | $\overline{SG2}$ (decay) | $\overline{SG1}$ (full) | $\overline{SG1}$ (full) |
| 0 | 0 | 1 | 0 | 0 | 1 (off) | 1 (off) | $\overline{SG2}$ (decay) | $\overline{SG1}$ (full) |
| 0 | 0 | 0 | 1 | 0 | 1 (off) | 1 (off) | 1 (off) | $\overline{SG2}$ (decay) |

During time zone Z1-, the VC1 output of the voice control logic circuit 94 carries the complement of the SG2 signal generated by the sample gating modulation circuit 42. At the same time, the outputs VC2–VC4 carry the complement of the output signal SG1 generated by the sample gating modulation circuit. The SG1 output is a maximum pulse width signal generated by OR gate 124 in the sample gating modulation circuit. See FIG. 6. This signal represents the combined pulse widths of the pulse trains A* and B* generated by the two phase clock 48. As such, the signal SG1 is equivalent to a maximum amplitude signal, indicating that no decay envelope is to be impressed upon signals V2, V3 or V4.

Thus, during time zone Z1-, the VC1 signal carries the decay modulation information ($\overline{SG2}$) which determines the decay envelope of the signal V1 at the demultiplexing audio waveshape generator circuit 16. At the same time, the signals VC2–VC4 indicate that no decay modulation ($\overline{SG1}$) is to be impressed on signals V2–V4 by wave-shape generator circuits 18, 20 and 22. At the end of time zone Z1-, the signal VC1 is maintained high as the decay cycle progresses through time zones Z2- through Z4-. Accordingly, the signal V1 is not sounded by waveshape generator circuit 16 in time zones Z2- through Z4-.

During the second time zone Z2-, the VC2 signal carries the decay modulation information ($\overline{SG2}$) for signal V2 while the VC3 and VC4 signals indicate that no decay modulation ($\overline{SG1}$) is to be impressed on signals V3 and V4. At the end of the second time zone Z2-, the VC2 signal is maintained high throughout time zones Z3- and Z4-.

During the third time zone Z3-, the VC3 signal carries the decay modulation information ($\overline{SG2}$) for signal V3 while the VC4 signal indicates that no decay modulation ($\overline{SG1}$) is to be impressed on signal V4. At the end of the third time zone Z3-, the VC3 signal is maintained high throughout the fourth time zone Z4-.

During the fourth time zone Z4-, the VC4 signal carries the decay modulation information ($\overline{SG2}$) for signal V4.

The decay modulation information carried by the outputs VC1-4 of voice control logic circuit 94 is correlated to the keyboard information provided by keyboard section decoder 96 via NOR gates 106, 108, 110 and 112 prior to the demultiplexing audio waveshape generator circuits 16, 18, 20 and 22. The operation of keyboard section decoder 96 is illustrated in Table 7 below.

TABLE 7

| KA | KB | KS1 | KS2 | KS3 | KS4 |
|---|---|---|---|---|---|
| 0 | 0 | 0 | 1 | 1 | 1 |
| 1 | 1 | 1 | 0 | 1 | 1 |
| 1 | 0 | 1 | 1 | 0 | 1 |
| 0 | 1 | 1 | 1 | 1 | 0 |

The outputs KS1–KS4 of the decoder 96 indicate which keyboard section of the keyboard 10 is associated with an active key at any given instant of time. A low signal at any of the outputs KS1–KS4 indicates a keyboard associated with an active key while a high signal indicates an inactive keyboard. Signals KS1–KS4 correspond to keyboards 1–4, respectively.

When a key associated with keyboard 1 is active, output KS1 of keyboard section decoder 96 enables the top NOR gate in the bank of NOR gates 106 to pass the VC1 output of voice control logic circuit 94 to the VC1 KS1 input of analog switch 98 in the audio waveshape generator circuit 16. See FIGS. 1B and 10. In addition, the KS1 signal enables the top NOR gate in the bank of NOR gates 108 to pass the VC2 output of voice control logic circuit 94 to one of the analog switches in the waveshape generator circuit 18; it enables the top NOR gate in the bank of NOR gates 110 to pass the VC3 output of voice control logic circuit 94 to one of the analog switches in waveshape generator circuit 20; and it enables the top NOR gate in the bank of NOR gate 112 to pass the VC4 output of voice control logic circuit 94 to one of the analog switches in waveshape generator circuit 22. The remaining NOR gates in the banks of NOR gates 106, 108, 110 and 112 are disabled by the KS2, KS3 and KS4 outputs of decoder 96.

Accordingly, waveshape generator circuits 16, 18, 20 and 22 will impress the information carried by signals VC1–VC4 on analog signals V1–V4 respectively. The VC1–VC4 signals will, in sequence, carry the SG1 and SG2 modulation signal generated by sample gating modulation circuit 42 as previously described. Thus, in the first time zone Z1-1 corresponding to keyboard section 1, the VCA2-1, VCA3-1 and VCA4-1 signals will not decay at all while the VCA1-1 signal will decay according to the modulation information provided by signal SG2 at the decay rate determined by data selector 120. In the second time zone Z2-1 corresponding to keyboard section 1, the VCA1-1 signal will have decayed to zero, the VCA2-1 signal will decay according to the decay modulation signal SG2 at the decay rate determined by data selector 120, and the VCA3-1 and VCA4-1 signals will not decay at all. In the third time zone Z3-1 corresponding to keyboard section 1, the VCA2-1 signal will have decayed to zero, the VCA3-1 signal will decay according to the decay modulation information signal SG2 at the rate determined by data selector 120, and the VCA4-1 signal will not decay at all. In the fourth time zone Z4-1 corresponding to keyboard section 1, the VCA1-1, VCA2-1 and VCA3-1 signals will have decayed to zero, and the VCA4-1 signal will decay according to the decay modulation signal SG2 at the decay rate determined by data selector 120. At the end of the fourth time zone, the VCA4-1 signal will have decayed to zero.

Figure 16:
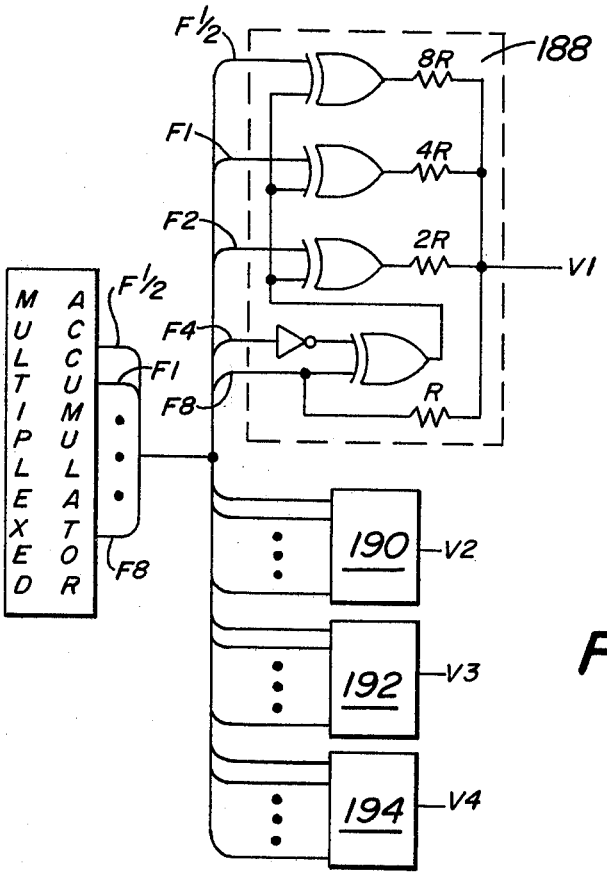
FIG. 16 is a diagram of a portion of a preferred alternative embodiment of the invention.

Although the preceding description of the invention relates to a preferred embodiment wherein the voice waveforms are stored in ROMs 1–4 which are associated with EXCLUSIVE OR gates 68, 78, 80, 82 and 84 and resistive networks 86, 88, 90 and 92, the sequential decay of the component signals of the composite audio signal CA according to the invention may also be obtained by replacing the ROMs 1–4 and the EXCLUSIVE OR gates and resistive networks with appropriate digital logic circuits 188, 190, 192 and 194 which combine the bit outputs of the multiplexed accumulator to produce the analog signals V1–V4. See FIG. 16. Any of the circuits 188, 190, 192 or 194 may have the configuration shown in dotted lines in circuit 188. Digital logic circuits such as circuit 188 are not per se the subject of invention herein and are described in detail in co-pending allowed patent application Ser. No. 787,696 for "Demultiplexing Audio Waveshape Generator" assigned to the assignee herein, incorporated herein by reference. Any of the digital logic circuits described in application Ser. No. 787,696 may be used in circuits 188, 190, 192 or 194 to generate the analog signals V1–V4.

In addition, the invention may also be practiced by substituting an analog waveshape memory, such as that described in U.S. Pat. No. 3,844,379 for "Electronic Musical Instrument With Key Coding In A Key Address Memory", for the ROMS1–4. Such a memory could be used to convert the octavely related signals at the output of the multiplexed accumulator to the analog signals V1–V4.

The foregoing description of the invention relates to the sequential decay of the component signals of the composite audible tone CA corresponding to an active key. For each keyboard section, there are 4 voice waveforms stored in memory which form the basis for the component signals. The rates of decay of the component signals vary from time zone to time zone and depend on the particular keyboard section in which the active key is located.

Although the preferred embodiment of the invention has been described in terms of the decay of the component signals from this zone to time zone wherein, for a particular time zone, certain of the component signals may not decay while at least one component signal does decay, it should be obvious that all component signals may be caused to decay simultaneously but at different rates in accordance with the principles of the invention such that the component signals reach a zero level at different successive points in time.

Figure 11:
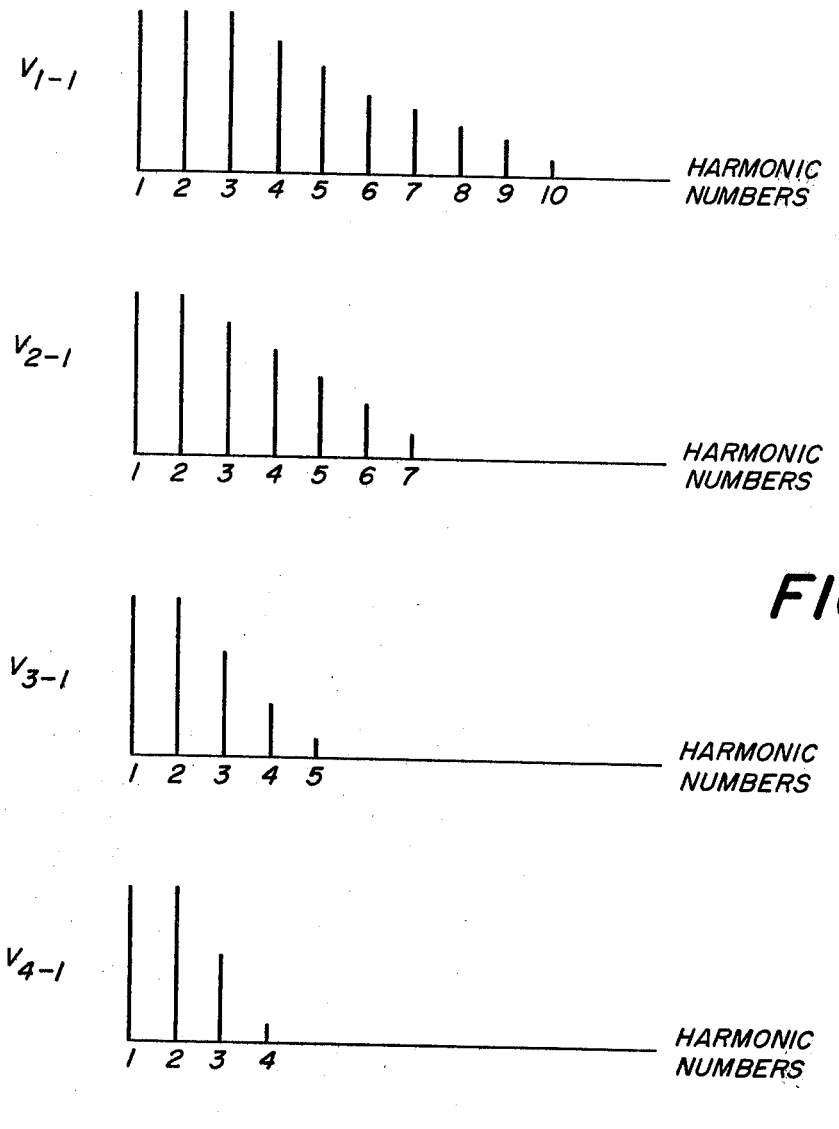
FIG. 11 is a diagram of the in-phase harmonics of four voices associated with one keyboard section.

In the preferred embodiment of the invention described herein, the harmonic content of the voices may be selected beforehand to enhance the percussive effect attained by the foregoing sequential decay of voices. Referring to FIG. 11, examples of the harmonic structures of the stored voices V1-1, V2-1, V3-1 and V4-1 corresponding to keyboard section 1 are shown. It is presumed that voice V1-1 contains 10 harmonics, voice V2-1 contains 7 harmonics, voice V3-1 contains 5 harmonics and voice V4-1 contains 4 harmonics. The sign of the amplitude of each harmonic may be positive or negative.

In FIG. 11, the sign of the amplitude of each harmonic is presumed to be positive, that is, the harmonics are in-phase. Accordingly, as the component signals of the composite audio signal are caused to decay in sequence in accordance with the pattern shown in FIG. 9, the composite tone will at first be rich in upper harmonics. As the decay cycle progresses, the upper harmonics drop out, each voice signal gradually disappearing as a source of such harmonics. Thus, each harmonic will gradually decay in intensity until the audible tone completely disappears.

To illustrate this effect, the amplitudes of the second harmonics of the components VCA1-1, VCA2-1, VCA3-1 and VCA4-1 corresponding to keyboard section 1 are shown in Table 8 below wherein it is assumed that the amplitude of the second harmonic of each component is 5 units and that a component decays in amplitude one unit at a time in the unit sequence 5-4-3-2-1-0 in each time zone of the decay pattern.

TABLE 8

| | | Time Zone | | | | | | | | | | | | | | | | | | | |
|---|---|---|---|---|---|---|---|---|---|---|---|---|---|---|---|---|---|---|---|---|---|
| | | Z1-1 | | | | | | | Z2-1 | | | | | Z3-1 | | | | | Z4-1 | | |
| Second Harmonic of Component Signal | VCA1-1 | 5 | 4 | 3 | 2 | 1 | | | 0 | | | | | 0 | | | | | 0 | | |
| | VCA2-1 | 5 | 5 | 5 | 5 | 5 | 5 | 4 | 3 | 2 | 1 | | | 0 | | | | | 0 | | |
| | VCA3-1 | 5 | 5 | 5 | 5 | 5 | 5 | 5 | 5 | 5 | 5 | 5 | 4 | 3 | 2 | 1 | | | 0 | | |
| | VCA4-1 | 5 | 5 | 5 | 5 | 5 | 5 | 5 | 5 | 5 | 5 | 5 | 5 | 5 | 5 | 5 | 5 | 4 | 3 | 2 | 1 |

Second Harmonic of

TABLE 8-continued

| | Time Zone | | | | | | | | | | | | | | | | | | | |
|---|---|---|---|---|---|---|---|---|---|---|---|---|---|---|---|---|---|---|---|---|
| | Z1-1 | | | | | Z2-1 | | | | | Z3-1 | | | | | Z4-1 | | | | |
| Composite Signal CA | 20 | 19 | 18 | 17 | 16 | 15 | 14 | 13 | 12 | 11 | 10 | 9 | 8 | 7 | 6 | 5 | 4 | 3 | 2 | 1 |

Figure 12:
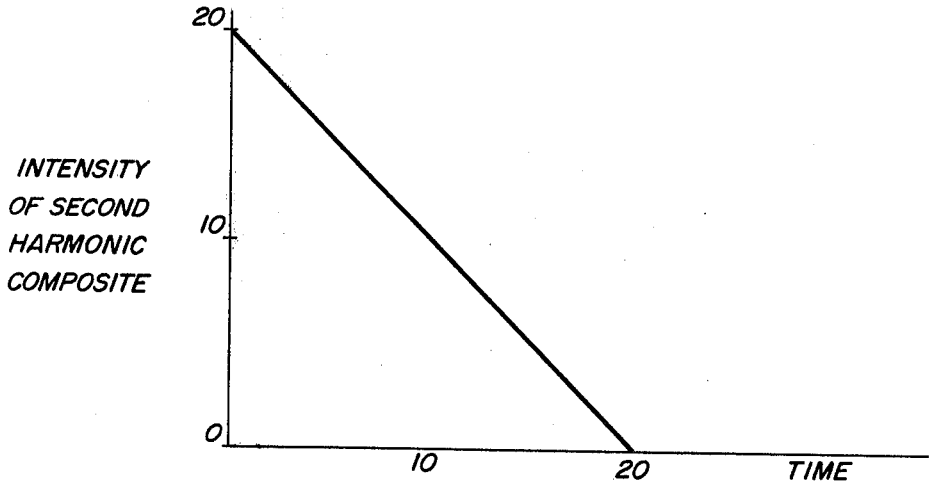
FIG. 12 is a graph of the pattern of decay of the second harmonic of a composite audible tone due to the voices in FIG. 11.

Since the harmonics of the stored voices shown in FIG. 11 are in-phase, the second harmonics will add or reinforce each other throughout the decay pattern. However, as the second harmonic of each component signal of the composite audio signal decays in sequence over the time zones, the additive effect will gradually decrease until there is no second harmonic in the composite tone. The gradual decay of the composite of the second harmonics of the component signals VCA1-1, VCA2-1, VCA3-1 and VCA4-1 is shown in FIG. 12.

Figure 13:
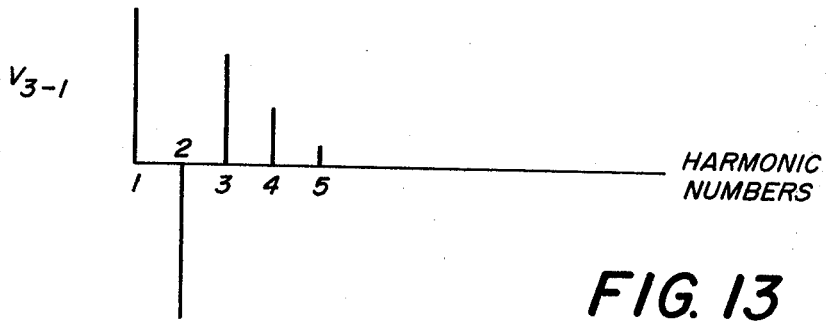
FIG. 13 is a diagram of the harmonics of voice V3-1 in FIG. 11 with an out-of-phase second harmonic.

The harmonic structure of the stored voices may, however, be varied to alter the harmonic structure of the percussive tone. For example, the harmonic structure of a percussive tone may be altered by selecting the second harmonics of at least two stored voices such that the harmonics are out of phase. For this purpose, voice V3-1 may be modified by reversing the polarity of the second harmonic. See FIG. 13. The resultant decay of the amplitudes of the second harmonics of the components VCA1-1, VCA2-1, VCA3-1 and VCA4-1 is then shown in Table 9 below.

TABLE 9

| | | Time Zone | | | | | | | | | | | | | | | | | | | |
|---|---|---|---|---|---|---|---|---|---|---|---|---|---|---|---|---|---|---|---|---|---|
| | | Z1-1 | | | | | Z2-1 | | | | | Z3-1 | | | | | Z4-1 | | | | |
| Second Harmonic of Component Signal | VCA1-1 | 5 | 4 | 3 | 2 | 1 | | | 0 | | | | | 0 | | | | | 0 | | |
| | VCA2-1 | 5 | 5 | 5 | 5 | 5 | 5 | 4 | 3 | 2 | 1 | | | 0 | | | | | 0 | | |
| | VCA3-1 | −5 | −5 | −5 | −5 | −5 | −5 | −5 | −5 | −5 | −5 | −5 | −4 | −3 | −2 | −1 | | | 0 | | |
| | VCA4-1 | 5 | 5 | 5 | 5 | 5 | 5 | 5 | 5 | 5 | 5 | 5 | 5 | 5 | 5 | 5 | 5 | 4 | 3 | 2 | 1 |
| Second Harmonic of Composite Signal CA | | 10 | 9 | 8 | 7 | 6 | 5 | 4 | 3 | 2 | 1 | 0 | 1 | 2 | 3 | 4 | 5 | 4 | 3 | 2 | 1 |

The composite of the second harmonics of the component signals corresponding to keyboard section 1 gradually decreases through the first two time zones in the decay pattern as in the case of the in-phase harmonics. However, in the third time zone, the composite of the second harmonics begins to increase as the negative second harmonic (the second harmonic of voice V3-1) begins to decay. In the fourth time zone, the negative harmonic will have decayed to zero, and the composite signal will follow the decay of the second harmonic of signal VCA4-1. The alternate decrease and increase in amplitude of the composite of the second harmonics of the components is illustrated in FIG. 14.

Figure 14:
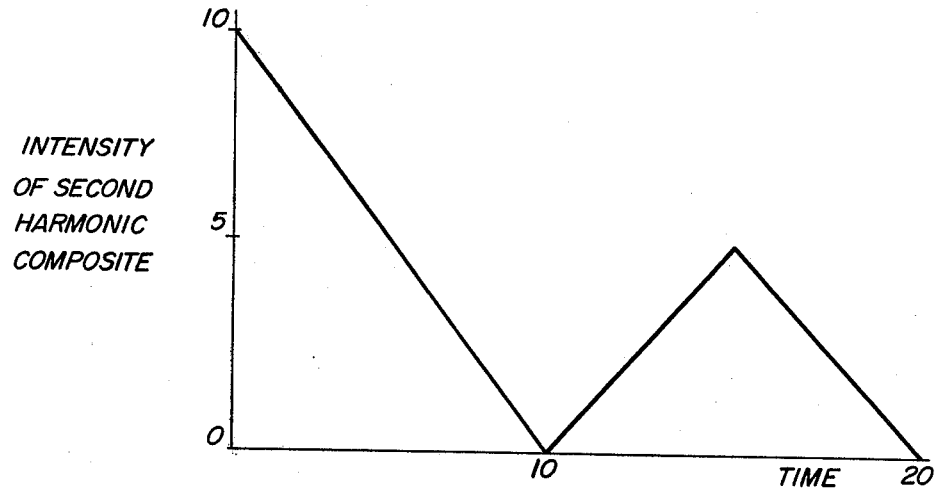
FIG. 14 is a graph of the pattern of decay and build-up of the second harmonic of a composite audible tone due to voice V3-1 in FIG. 13.

Percussive tones generated by a piano, harpsichord or the like may exhibit the alternate decrease and increase in tone harmonics such as indicated in FIG. 14. Accordingly, by storing voice information in memory 26 such that particular harmonics of the voices which corresponds to the same keyboard section will be subtractive (out of phase), rather than additive (in-phase), it is possible to produce a wide range of percussive tones of changing harmonic structures.

Figure 17:
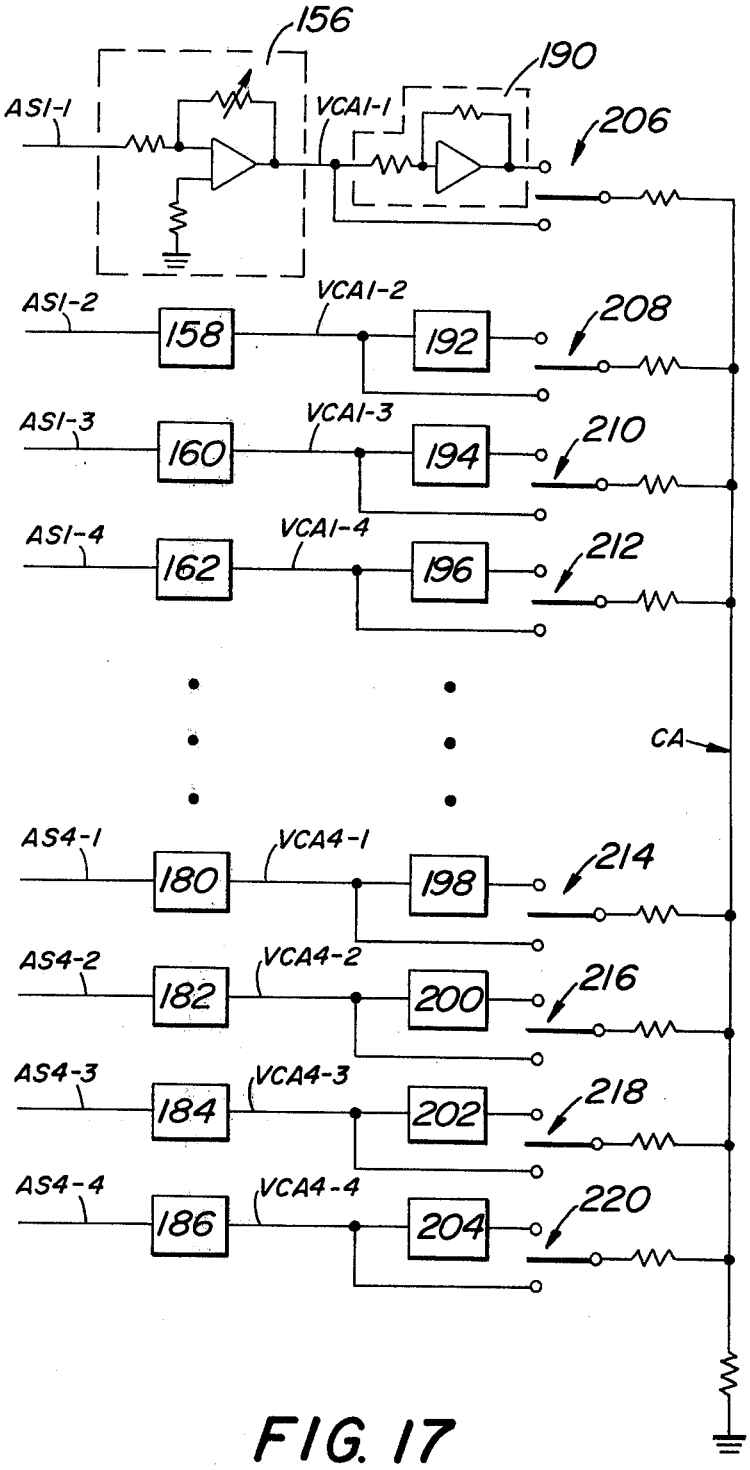
FIG. 17 is a diagram of an alternative embodiment of the invention for inverting the harmonic structure of a component signal.

Alternatively, the alternate decrease and increase in the composite of the second harmonics shown in FIG. 14 may be obtained by selectively inverting one or more of the outputs (VCA1-1 through -4, VCA2-1 through -4, VCA3-1 through -4 and VCA4-1 through -4) of the adjustable gain amplifiers 156–186. For this purpose, an inverter amplifier-switch pair may be connected to the output of one or more of the amplifiers 156–186 as shown in FIG. 17.

The inverter amplifiers 190–204 are identical and have the detailed structure of inverter amplifier 190. The outputs of each adjustable gain amplifier and the associated inverter amplifier are connected in pairs to the terminals of SPDT switches 206–220. Assume that all harmonics of all component signals generated by the adjustable gain amplifiers are positive, i.e., in-phase. If it is desired to create an out of phase harmonic (such as the second harmonic) in a component signal generated by an adjustable gain amplifier, the switch associated with the amplifier is thrown to the upper position to connect the associated inverter output to the resistive summing network which produces the composite audio signal CA. At least one other switch of switches 208–220 associated with the same keyboard section would remain in the lower position to connect the associated adjustable gain amplifier directly to the resistive summing network. For example, switch 206 would be thrown to the upper position to cause the VCA1-1 output of adjustable gain amplifier 156 (corresponding to keyboard section 1) to be inverted by inverter amplifier 190 before being passed to the resistive summing network. Switches 208–220 may remain in the lower positions. The inversion of the VCA1-1 component signal has the effect of making each harmonic of the VCA1-1 signal negative, i.e., out of phase with the (positive) harmonics of the component signals VCA1-2 through -4. As a result, an alternate decrease and increase in the composite of each harmonic will be experienced as previously described.

The present invention may be embodied in other specific forms without departing from the spirit or essential attributes thereof and, accordingly, reference should be made to the appended claims, rather than to the foregoing specification as indicating the scope of the invention.

I claim:

1. A digital electronic musical instrument for generating audible percussive tones in response to actuation of a key in a keyboard having one or more keyboard sections, comprising:

a memory for storing voice information, means for addressing said memory and for producing a set of analog signals based on said voice information, means for generating a composite audio signal comprising plural component signals based on said set of analog signals, means for repetitively generating a sequence of decay scale factors, detecting means for detecting the completion of a sequence of said decay scale factors, and decay means for causing said component signals to decay at least one signal at a time in a preselected sequence over plural successive time zones of preselected duration based on the number of sequences of decay scale factors detected by said detecting means.

2. The digital electronic musical instrument according to claim 1 including means for identifying the keyboard section in which an active key is located, and means for varying the rate of decay of each of said component signals over said plural successive time zones in response to said keyboard section identifying means.

3. The digital electronic musical instrument according to claim 1 wherein said decay means includes means for generating a frequency modulated sample gating signal, means for modulating the pulse width of said frequency modulated sample gating signal, and means for causing said component signals to decay in accordance with the frequency and pulse width modulated sample gating signal.

4. The digital electronic musical instrument according to claim 1 wherein said means for addressing said memory includes means for addressing said memory in a first sequence of addresses and a second sequence of addresses, said first sequence and said second sequence of addresses being opposite in order.

5. The digital electronic musical instrument according to claim 1 wherein said voice information stored in memory comprises plural sample points of at least two waveshapes, each waveshape having plural harmonics, at least one of the harmonics of one waveshape and at least one of the harmonics of the other waveshape being of the same order but different phase.

6. The digital electronic musical instrument according to claim 1 including means for selectively inverting at least one and less than all of said component signals.

7. A method of producing an audible percussive tone in response to actuation of a key in a keyboard having one or more keyboard sections, comprising:

storing a plurality of musical instrument voices in memory, each of said instrument voices comprising a plurality of preselected digital words, retrieving the stored digital words from memory and producing a plurality of analog signals based thereon, generating a composite audio signal comprising plural component signals based on said analog signals, repetitively generating a sequence of decay scale factors, detecting the completion of a sequence of said decay scale factors, and causing said component signals to decay at least one signal at a time in a preselected sequence over plural successive time zones of preselected duration based on the number of sequences of decay scale factors detected.

8. The method according to claim 7 including generating a digital signal which identifies the keyboard section in which an active key is located, and varying the rate of decay of said component signals over said plural successive time zones based on said digital signal.

9. The method according to claim 7 including generating a frequency modulated sample gating signal, modulating the pulse width of said frequency modulated sample gating signal, and causing said component signals to decay in response to the frequency and pulse width modulated sample gating signal.

10. The method according to claim 7 wherein said step of retrieving said stored digital words includes retrieving said words in a first sequence and in a second sequence, said first and second sequences being opposite in order.

11. The method according to claim 7 wherein each of said voices stored in memory comprise plural harmonics, at least two of said voices having harmonics of the same order but different phase.

12. The method according to claim 7 including selectively inverting at least one and less than all of said component signals.

13. A digital electronic musical instrument for generating audible percussive tones in response to actuation of a key in a keyboard having one or more keyboard sections, comprising:

a memory for storing a plurality of musical instrument voices, each of said instrument voices comprising a plurality of preselected digital words, means for addressing said memory and for producing plural analog signals, each analog signal representing one of said stored instrument voices, a plural state counter, means for clocking said plural state counter at a preselected rate, means for generating a sequence of decay scale factors at an adjustable rate, means connected to said means for generating said sequence of decay scale factors and said plural state counter for generating a sample gating modulation signal based on the digital magnitude of the contents of said counter and said decay scale factors, means connected to said means for generating said sample gating modulation signal for generating plural voice control signals based on the rate at which said sequence of decay scale factors is generated and on said sample gating modulation signal, and means for sequentially modulating the amplitude of each of said analog signals, at least one analog signal at a time, over plural successive time zones of preselected durations in response to said voice control signals.

14. The digital electronic musical instrument according to claim 13 wherein said means for sequentially modulating each of said analog signals includes plural analog switches for receiving said analog signals in response to said voice control signals.

15. The digital electronic musical instrument according to claim 13 wherein each of said voices stored in memory comprise plural harmonics, at least two of said voices having harmonics of the same order but different phase.

16. The digital electronic musical instrument according to claim 13 including means for identifying the keyboard section in which an active key is located, and means for varying the rate of modulation of said analog signals over said plural successive time zones in response to said keyboard section identifyig means.

17. A digital electronic musical instrument for generating audible percussive tones in response to actuation of a key in a keyboard having one or more keyboard sections, comprising:

means for producing plural octavely related digital signals in response to actuation of a key in said keyboard, means for producing a set of analog signals based on said octavely related digital signals, means for generating a composite audio signal comprising plural component signals based on said set of analog signals, means for repetitively generating a sequence of decay scale factors, detecting means for detecting the completion of a sequence of said decay factors, and means for causing said component signals to decay at least one signal at a time in a preselected sequence over plural successive time zones of preselected duration based on the number of sequences of decay scale factors detected by said detecting means.

18. The digital electronic musical instrument according to claim 17 including means for identifying the keyboard section in which an active key is located, and means for varying the rate of decay of each of said component signals over said plural successive time zones in response to said keyboard section identifying means.

19. The digital electronic musical instrument according to claim 17 wherein said decay means includes means for generating a frequency modulated sample gating signal, means for modulating the pulse width of said frequency modulated sample gating signal, and means for causing said component signals to decay in accordance with the frequency and pulse width modulated sample gating signal.

20. The digital electronic musical instrument according to claim 17 including means for selectively inverting at least one and less than all of said component signals.

21. A method of producing an audible percussive tone in respone to actuation of a key in a keyboard having one or more keyboard sections, comprising:

producing plural octavely related digital signals in response to actuation of a key in said keyboard, producing a set of analog signals based on said octavely related digital signals, generating a composite audio signal comprising plural component signals based on said analog signals, repetitively generating a sequence of decay scale factors, detecting the completion of a sequence of said decay scale factors, and causing said component signals to decay at least one signal at a time in a preselected sequence over plural successive time zones of preselected duration based on the number of sequences of decay scale factors detected.

22. The method according to claim 21 including generating a digital signal which identifies the keyboard section in which an active key is located, and varying the rate of decay of said component signals over said plural successive time zones based on said digital signal.

23. The method according to claim 21 including generating a frequency modulated sample gating signal, modulating the pulse width of said frequency modulated sample gating signal, and causing said component signals to decay in response to the frequency and pulse width modulated sample gating signal.

24. The method according to claim 21 including selectively inverting at least one and less than all of said component signals.

* * * * *